United States Patent [19]

Bédard

[11] Patent Number: 4,905,746

[45] Date of Patent: Mar. 6, 1990

[54] LOG SPLITTER

[76] Inventor: Claude Bédard, 1892 Blvd. Henri-Bourassa E., Apt. 26, Montreal North, Quebec H3B 1S1, Canada

[21] Appl. No.: 340,507

[22] Filed: Apr. 19, 1989

[51] Int. Cl.[4] ..... B27L 7/00

[52] U.S. Cl. ..... 144/193 D; 144/193 R

[58] Field of Search ..... 144/193 R, 193 C, 193 D; 254/104

[56] References Cited

U.S. PATENT DOCUMENTS

| | | | |
|---|---|---|---|
| 3,982,572 | 9/1976 | Kortendick | 144/193 D |
| 4,211,264 | 7/1980 | Cross | 144/193 D |
| 4,274,458 | 6/1981 | Dueweke et al. | 144/193 D |
| 4,391,311 | 7/1983 | Levercom | 144/193 D |

FOREIGN PATENT DOCUMENTS

| | | | |
|---|---|---|---|
| 1031669 | 5/1978 | Canada . | |
| 1130175 | 8/1982 | Canada . | |
| 26353 | 10/1953 | Finland | 144/193 D |

*Primary Examiner*—W. Donald Bray

[57] ABSTRACT

A log splitter having a log splitting unit slidably mounted on a vertical post. The splitting unit has a guiding member slidably mounted on the post with a support arm extending from the guiding member in a direction transverse to the post. A splitting member is slidably mounted in the free end of the support arm for movement in a direction parallel to the post. The splitting unit is raised to set a log on the splitter under the splitting member. The splitting member is then driven down with a blow, relative to the guiding member and support arm, to split the log.

6 Claims, 2 Drawing Sheets

LOG SPLITTER

BACKGROUND OF THE INVENTION

1. Field of the Invention

This invention is directed toward an improved log splitter.

2. DESCRIPTION OF THE PRIOR ART

The invention is more particularly directed toward an improved log splitter of the type having a splitting unit slidably mounted on a vertical post. The splitting unit comprises a guiding member slidably mounted on the post, a support arm extending transversely from the guiding member, and a wedge fixed to the free end of the support arm. The splitting unit is raised along the post, a log is placed under the wedge adjacent the post, and the wedge is then driven down into the log, usually with a manually applied blow, to split the log. Examples of such splitters are shown in U.S. Pat. No. 4,211,264, issued July 8, 1980, Robert M. Cross inventor; and Canadian Pat. No. 1,031,669, issued May 23, 1978, Carl F. Piontkowski, inventor.

The known splitters of above type have some disadvantages. Since the wedge is cantilevered from the post by the support arm, a blow on the wedge results in a large bending force on the support arm adjacent the post. To be able to handle this large bending force, the support arm can be made quite deep, vertically (as shown in Canadian Patent No. 1,031,669 for example). However this makes the splitting unit quite heavy and more work must be expended in lifting the splitting unit when splitting wood. The bending force can be reduced by shortening the support arm (as shown in U.S. Pat. No. 4,211,264 for example). However a splitting unit incorporating a short support arm cannot be used satisfactorily to split large diameter logs since the distance between the post and the wedge is often less than half the diameter of the logs.

The known splitters also all require considerable effort to lift the splitting unit to a splitting position. Not only must the wedge itself be raised, but also the attached support arm and the attached guide member on the post.

SUMMARY OF THE INVENTION

It is the purpose of the present invention to provide a log splitter of the type employing a splitting unit slidable on a vertical post, that minimizes bending forces when the wedge is struck a blow. It is another purpose of the present invention to provide a log splitter of the above type that does not require as much work to lift the splitting unit to a splitting position.

In accordance with the present invention there is provided a log splitter of the type having a vertical post with a splitting unit, having a support arm carrying a splitting member, slidably mounted on the post. In one embodiment of the invention, the splitting member itself is slidably mounted on the support arm for movement in a direction parallel to the post. In this embodiment, when the splitting member is struck a blow, the splitting member moves down vertically relative to the support arm and little or no bending force is applied to the support arm at the post as a result of the blow. Thus the support arm can be made lighter and/or longer making for a better and/or cheaper splitter.

In another embodiment of the invention the splitting member can be fixed to the support arm. A counterweight system is provided however so that the splitting unit which includes the support arm and the splitting member, can be raised with much less effort. The counterweight system can comprise a weight slidably mounted within the post of the log splitter. A cable, passing over a pulley at the top of the post connects the weight and the splitting unit together.

In the preferred embodiment of the invention, there is provided a log splitter incorporating both a slidably mounted splitting member on a slidably mounted splitting unit, and a counterweight system for more easily moving the splitting unit.

The invention, in one embodiment, is particularly directed toward a log splitter having a base and a support post extending vertically up from the base. A splitting unit is mounted on the post. The splitting unit has a support arm extending transversely from the post and a splitting member, extending parallel to the post, slidably mounted on the support arm.

The invention, in another embodiment, is particularly directed toward a log splitter having a base and a support post extending vertically up from the base. A splitting unit is slidably mounted on the post. The splitting unit has a support arm extending transversely from the post and a splitting member, extending parallel to the post, mounted on the support arm. The log splitter includes a counterweight, and pulley means at the top of the support post. A cable passes over the pulley means to connect the splitting unit to the counterweight.

DESCRIPTION OF THE PREFERRED EMBODIMENT

Figures 1, 2, 3:
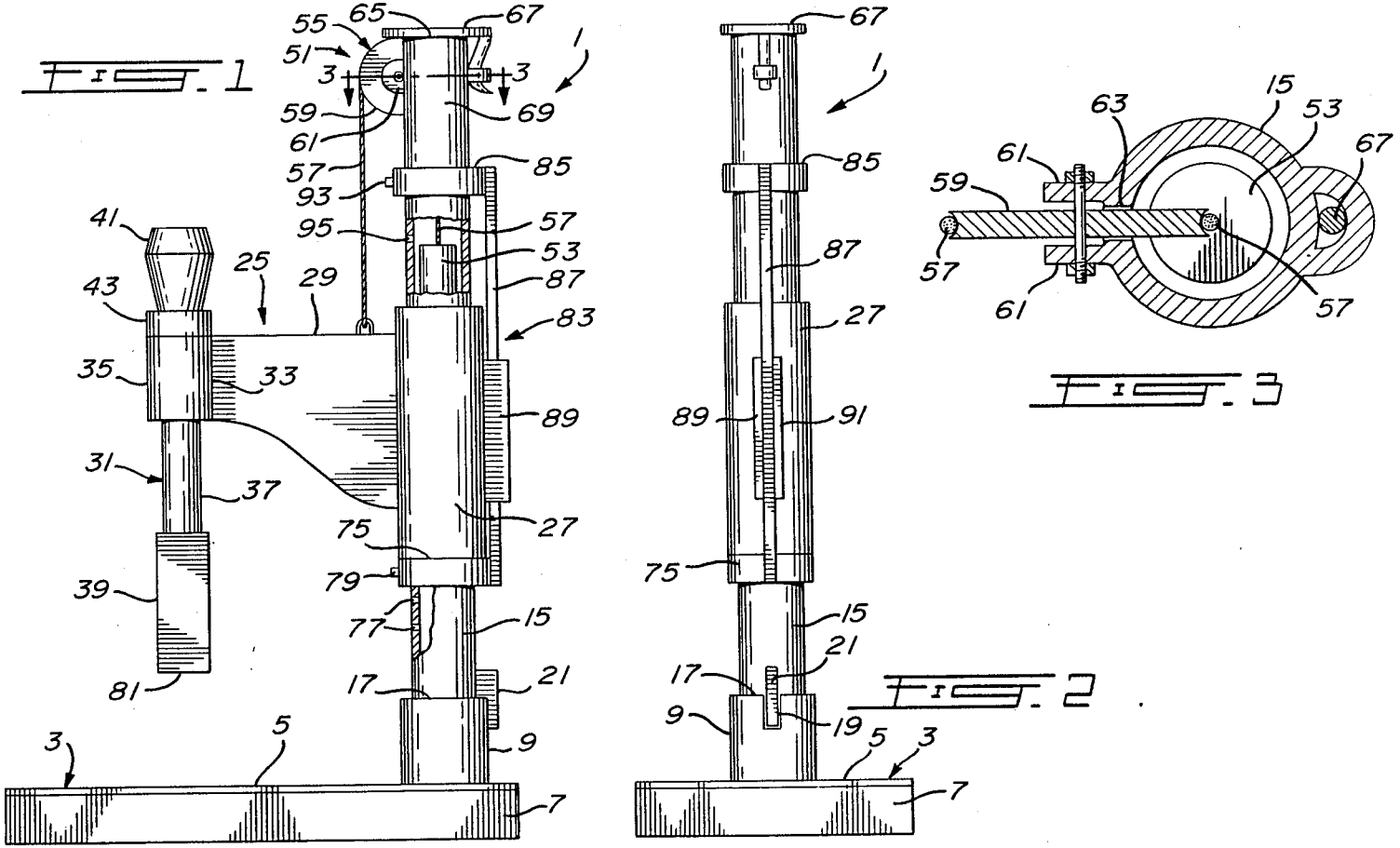
FIG. 1 is a side view of the preferred embodiment of the wood splitter, in partial section.
FIG. 2 is a rear view of the splitter.
FIG. 3 is a cross-section view taken along line 3—3 of FIG. 1.

The preferred embodiment of the log splitter 1 of the present invention, as shown in FIGS. 1 to 3 has a base 3. The base 3 can be formed from a rectangular, metal top plate 5 mounted on square-sectioned lengths of wood 7. A short, tubular, mounting member 9 is fastened in an upright position to the top plate 5 near one end edge of the plate.

The log splitter has a support post 15. The support post 15 preferably comprises a cylindrical tube. One end of the post 15 is snugly mounted within the mounting member 9 on the base 3 to have the post extend vertically up from the base. The upper edge 17 of the mounting member 9 can be notched as shown at 19. A locating bar 21 can be attached to the post 15 near its lower end. When the lower end of the post 15 is inserted into the mounting member 9, it can be rotated to fit the bar 21 on the post 15 within the notch 19 so as to prevent rotation of post 15 relative to member 9.

A splitting unit 25 is slidably mounted on the post 15. The splitting unit 25 has a short tubular guide member 27, a support arm 29 extending transversely from the guide member 27, and a splitting member 31 mounted on the free end 33 of the support arm 29. The splitting member 31 extends parallel to the post 15 when the splitting unit 25 is mounted on the post 15 via the guide member 27. The splitting member 31 is slidably mounted on the support arm 29, passing through a second short tubular guide member 35 mounted on the free end 33 of support arm 29. The splitting member 31 comprises a central shaft 37 with a wedge 39 at one end of the shaft and an impact head 41 at the other end of the shaft. The shaft 37 passes snugly through the second guide member 35. The impact head 41 is enlarged to prevent the splitting member from falling through the second guide member 35. The wedge 39 can be detachably connected to the shaft 37 (by suitable means, not shown) to facilitate mounting of the splitting member 31 on the second guide member 35. A resilient collar 43 can be loosely mounted about shaft 37 between the impact head 41 and the guide member 35.

A counterweight system 51 is included in the log splitter 1 to make it easier to raise the splitting unit 25. The counterweight system 51 includes a counterweight 53 and pulley means 55 mounted at the top of the post 15. A cable 57 passes over the pulley means 55 to connect the counterweight 53 and splitting unit 25 together. The counterweight 53 is preferably sized to slide freely within post 15. The pulley means 55 can comprise a single pulley 59 rotatably mounted between brackets 61 at the top of post 15. A slot 63 as shown in FIG. 3, can be provided in the top end 65 of the post 15 so as to locate a portion of pulley 59 within the post. A removable cover 67 on the top end 65 of the post overlies the pulley 59 to help maintain the cable 57 in the pulley. A top section 69 of the post 15 can be made detachable to facilitate mounting of the splitting unit 25 on the post, and mounting of the counterweight system 51 on the splitter.

A positioning ring 75 can be mounted on the post 15 above the mounting member 9. A set of vertically spaced-apart holes 77 in the post 15 allow the ring 75 to be mounted on the post at a selected height with a pin 79 passing through a hole in the ring 75 and one of the post holes 77. The splitting unit 25 rests on the rig 75. The height at which the ring 75 is mounted on post 15 is determined by the average length of the wood to be split. Normally the ring 75 is located at a height where, when the splitting member 31 is raised, a log can just be positioned under the pointed edge 81 of the wedge 39 on the base 3. If a longer log is encountered, the entire splitting unit 25 is raised a short distance above ring 75. The ring 75 prevents the splitting unit 25 from falling all the way down the post 15 after a log is split.

The positioning ring 75 can form part of a guide means 83 which prevents rotation of the splitting unit 25 relative to the post 15. The guide means 83 includes a second ring 85 slidably mounted on the post 15 above the splitting unit 25. A guide bar 87 joins the rings 75, 85 together. A pair of vertical flanges 89, 91 extend rearwardly from the guide member 27 of the splitting unit 25. The guide bar 87 is located between the flanges 89,91. The second ring 85 can also be locked against rotation relative to post 15 with a pin 93 inserted through a hole in ring 85 and one of a set of vertically spaced-apart holes 95 in the post 15. The pins 79, 93 prevent rotation of the guide means 83 on the post 15, and the guide means 83, via guide bar 87 located between flanges 89, 91, prevents rotation of the splitting unit 25 relative to the post 15.

Figure 5:
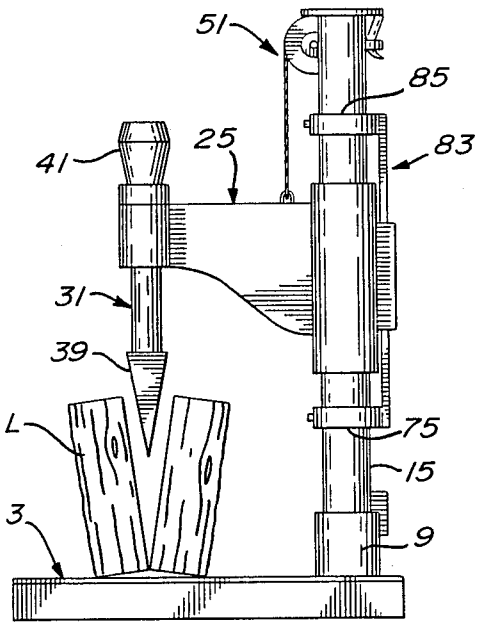
FIG. 5 is a side view showing the splitter just after initial impact.
Figure 4:
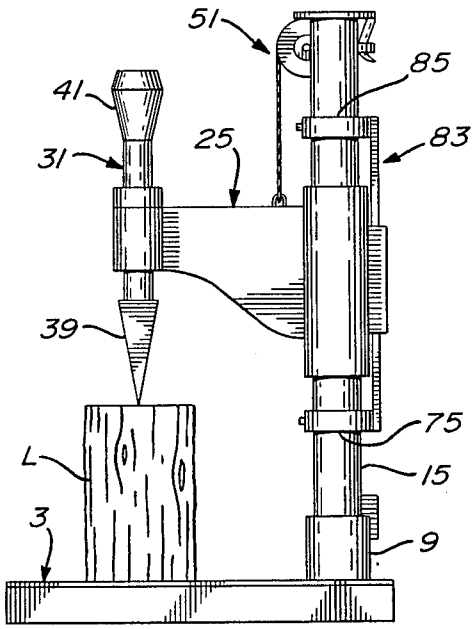
FIG. 4 is a side view showing the splitter ready to split a log.

In use, the positioning ring 75 of the log splitter is set at a selected height. The splitting member 31 is then raised, and if necessary, so is the splitting unit 25 to place a log "L" under the wedge 39 as shown in FIG. 4. A blow is then delivered to the impact head 41 of the splitting member 31 driving it down relative to the rest of the splitting unit 25 and driving the wedge 39 into the log to split it as shown in FIG. 5. Since only the splitting member 31 moves, and moves vertically during splitting, there are no bending forces on the splitting unit. Once the log is split, the entire splitting unit 25 can move down onto the positioning ring 75 as shown in FIG. 1, if it had been raised.

The preferred embodiment of the log splitter 1, described above, can be modified by eliminating the counterweight system 51. The splitting unit 2 can be raised without the counterweight system although it takes more work. The preferred embodiment of the log splitter can be further modified by eliminating the positioning ring 75 and guide means 83, and not requiring the positioning ring 75, can also be used.

Figure 6:
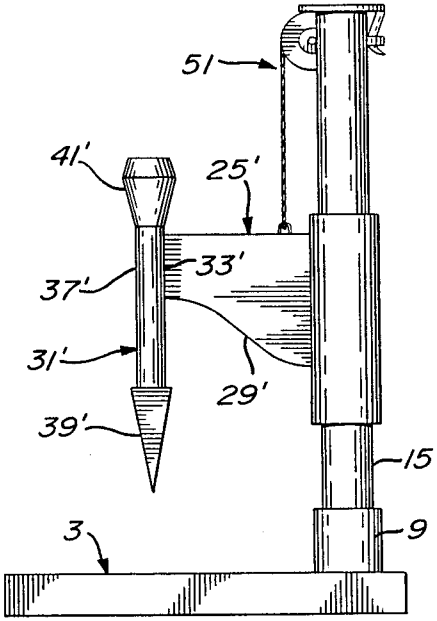
FIG. 6 is a side view showing another embodiment of the splitter.

In another embodiment of the invention, the log splitter can be modified to incorporate a fixed splitting member in the splitting unit along with using the counterweight system 51. As shown in FIG. 6, the splitting unit 25' can be modified to eliminate the tubular guide member 35 and to fasten the splitting member 31' directly to the free end 33' of support arm 29'. The shaft 37' of the splitting member 31' can be welded directly to the support arm 29' at its free end 33'. While this splitting unit 25' is now subject to bending forces and must be made stronger and heavier, the attached counterweight system 51 makes it easy to handle.

I claim:

1. A log splitter having a base; a support post extending vertically up from the base; a splitting unit; means on the splitting unit for slidably mounting it on the support post; the splitting unit having a support arm extending transversely from the post and a splitting member, extending parallel to the post, slidably mounted on the support arm.

2. A log splitter as claimed in claim 1 including a counterweight, pulley means at the top of the post, and a cable passing over the pulley means to connect the counterweight to the slidable splitting unit.

3. A log splitter as claimed in claim 2 wherein the support post is tubular and the counterweight is sized to slide within the post.

4. A log splitter as claimed in claim 1 including a positioning ring on the support post beneath the splitting unit, and means for fixing the ring to the post at one of a number of selected heights.

5. A log splitter as claimed in claim 3 including a positioning ring on the support post beneath the splitting unit, and means for fixing the ring to the post at one of a number of selected heights.

6. A log splitter having a base; a support post extending vertically up from the base; a splitting unit slidably mounted on the post; the splitting unit having a support arm extending transversely from the post and a splitting member, extending parallel to the post, mounted on the support arm; a counterweight; pulley means at the top of the support post; and a cable passing over the pulley means to connect the splitting unit to the counterweight.

* * * * *